US011136220B2

(12) United States Patent
Kondo et al.

(10) Patent No.: US 11,136,220 B2
(45) Date of Patent: Oct. 5, 2021

(54) ELEVATOR DEVICE

(71) Applicant: Mitsubishi Electric Corporation, Tokyo (JP)

(72) Inventors: Rikio Kondo, Tokyo (JP); Seiji Watanabe, Tokyo (JP); Morishige Minobe, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 290 days.

(21) Appl. No.: 16/470,981

(22) PCT Filed: Jan. 16, 2018

(86) PCT No.: PCT/JP2018/001039
§ 371 (c)(1),
(2) Date: Jun. 19, 2019

(87) PCT Pub. No.: WO2018/150786
PCT Pub. Date: Aug. 23, 2018

(65) Prior Publication Data

US 2020/0002134 A1 Jan. 2, 2020

(30) Foreign Application Priority Data

Feb. 17, 2017 (JP) ..... JP2017-027831

(51) Int. Cl.
*B66B 1/32* (2006.01)
*B66B 11/02* (2006.01)
(Continued)

(52) U.S. Cl.
CPC ..... *B66B 11/0286* (2013.01); *B66B 1/32* (2013.01); *B66B 1/3476* (2013.01); *B66B 5/16* (2013.01)

(58) Field of Classification Search
CPC ..... B66B 1/32; B66B 5/18; B66B 5/0031; B66B 5/04; B66B 5/02; B66B 11/008;
(Continued)

(56) References Cited

U.S. PATENT DOCUMENTS

2011/0283814 A1* 11/2011 Fischer ..... B66B 5/0093 73/862.61
2012/0318613 A1* 12/2012 Stolt ..... H02P 23/06 187/247
(Continued)

FOREIGN PATENT DOCUMENTS

JP 11-79628 A 3/1999
JP 2001-19292 A 1/2001
(Continued)

OTHER PUBLICATIONS

International Search Report and Written Opinion dated Mar. 6, 2018 for PCT/JP2018/001039 filed on Jan. 16, 2018, 11 pages including English Translation of the International Search Report.

*Primary Examiner* — Marlon T Fletcher
(74) *Attorney, Agent, or Firm* — Xsensus LLP

(57) ABSTRACT

Provided is an elevator device including a main rope configured to support a car and a counterweight, a hoisting machine configured to be driven with the main rope wound therearound, a hoisting-machine controller configured to control the hoisting machine, a car brake controller configured to control a car brake device configured to apply a load to car rails to control raising and lowering of the car, and a vibration detection device configured to detect vibration of the car. When the vibration of the car is detected based on an output signal from the vibration detection device under a running state in which the hoisting-machine controller controls drive of the hoisting machine, the car brake controller
(Continued)

controls the car brake device to generate a braking force until the vibration becomes smaller than a set value.

7 Claims, 6 Drawing Sheets

(51) Int. Cl.
*B66B 1/34* (2006.01)
*B66B 5/16* (2006.01)

(58) Field of Classification Search
CPC ..... B66B 11/02; B66B 11/08; B66B 7/06; B66B 1/3492; B66B 11/0045; B66B 5/16; B66B 5/0018; B66B 1/36; B66B 5/0068; B66B 5/12; B66B 7/068; B66B 15/02
See application file for complete search history.

(56) References Cited

U.S. PATENT DOCUMENTS

2014/0229011 A1* 8/2014 Fukui ..... G05B 15/02 700/275
2015/0336768 A1* 11/2015 Otsuka ..... B66B 1/36 187/394
2016/0214832 A1* 7/2016 Banno ..... B66B 1/3492
2017/0088398 A1* 3/2017 Kuczek ..... B66B 5/22
2018/0201477 A1* 7/2018 Shibata ..... B66B 5/06
2019/0382237 A1* 12/2019 Witczak ..... B66B 3/002
2020/0002134 A1* 1/2020 Kondo ..... B66B 1/32
2020/0039789 A1* 2/2020 Illan ..... B66B 1/32
2020/0130985 A1* 4/2020 Ruhnke ..... B66B 5/18
2021/0016998 A1* 1/2021 Haag ..... B66B 19/002
2021/0139277 A1* 5/2021 Kattainen ..... B66B 5/0031

FOREIGN PATENT DOCUMENTS

JP 2003-192242 A 7/2003
JP 2004-35163 A 2/2004
JP 2008-150186 A 7/2008
JP 2008-230779 A 10/2008
JP 2009-12932 A 1/2009
JP 2012-515126 A 7/2012
JP 2014-65589 A 4/2014
JP 2016-3137 A 1/2016

* cited by examiner

ELEVATOR DEVICE

CROSS-REFERENCE TO RELATED APPLICATIONS

The present application is based on PCT filing PCT/JP2018/001039, filed Jan. 16, 2018 which claims priority to JP 2017-027831, filed Feb. 17, 2017, the entire contents of each are incorporated herein by reference.

TECHNICAL FIELD

The present invention relates to an elevator device including a brake device provided to a car.

BACKGROUND ART

It is known that a traction type elevator device supports and drives a car with use of a main rope, and hence the car shakes due to stretching and shrinking of the main rope or lateral oscillation occurs due to slacking of the main rope itself. In particular, in a traction type elevator device having a large vertical travel distance, which is installed in, for example, a high-rise building, the stretching and shrinking or the slacking is liable to occur because of the use of the main rope having a long length.

Accordingly, the above-mentioned shaking or oscillation is liable to occur.

In the related art, brake devices are provided to the car and a counterweight to prevent jumping of the car or the counterweight and slacking of the main rope resulting therefrom, which may otherwise be caused by an operation of a brake for a hoisting machine or a buffer especially in case of emergency stop. With the configuration described above, collision of the car or the counterweight against a device in a hoistway due to the slacking of the main rope or generation of a large impact force at the time when the main rope becomes taut again after slacking is prevented (see, for example, Patent Literature 1).

CITATION LIST

Patent Literature

[PTL 1] JP 2012-515126 A1 (paragraph 0021)

SUMMARY OF INVENTION

Technical Problem

In the elevator device described above, the shaking caused by the stretching and shrinking of the main rope cannot be eliminated under states other than the emergency stop condition. As a result, there arise problems in that the shaking of the car that is currently running may increase to impair ride comfort and that the main rope may resonate with side-to-side shaking of a construction, which is caused by an earthquake or a strong wind, to swing and collide against the device in the hoistway.

Further, in the elevator device having a large vertical travel distance, which is installed in, for example, the high-rise building, the main rope is liable to oscillate. In addition, the long main rope is arranged between the car and the hoisting machine. Thus, there is a problem in that it is difficult to suppress the shaking of the car through the control of the drive of the hoisting machine alone.

The present invention has been made to solve the problems described above, and has an object to provide an elevator device capable of eliminating shaking of a car regardless of a state of a main rope.

Solution to Problem

In order to achieve the above-mentioned object, an elevator device according to one embodiment of the present invention includes a car, a counterweight, a main rope configured to support the car and the counterweight, a hoisting machine to be driven with the main rope wound therearound, car rails configured to guide the car, a car brake device configured to apply a load to the car rails to control raising and lowering of the car, a hoisting-machine controller configured to control the hoisting machine, a car brake controller configured to control the car brake device, and a vibration detection device configured to detect vibration of the car. When the vibration of the car is detected based on an output signal from the vibration detection device under a running state in which the hoisting-machine controller controls the drive of the hoisting machine, the car brake controller controls the car brake device to generate a braking force until the vibration becomes smaller than a set value.

Advantageous Effects of Invention

The elevator device according to one embodiment of the present invention is configured such that, when the vibration of the car is detected based on the output signal from the vibration detection device under the running state, the car brake device is controlled to generate the braking force until the vibration becomes smaller than the set value. Accordingly, the effect of reducing the shaking of the car, which is caused by the stretching and shrinking of the main rope, to improve ride comfort is obtained.

DESCRIPTION OF EMBODIMENTS

Now, an elevator device according to each of various embodiments of the present invention is described in detail with reference to the accompanying drawings.

First Embodiment

Figure 1:
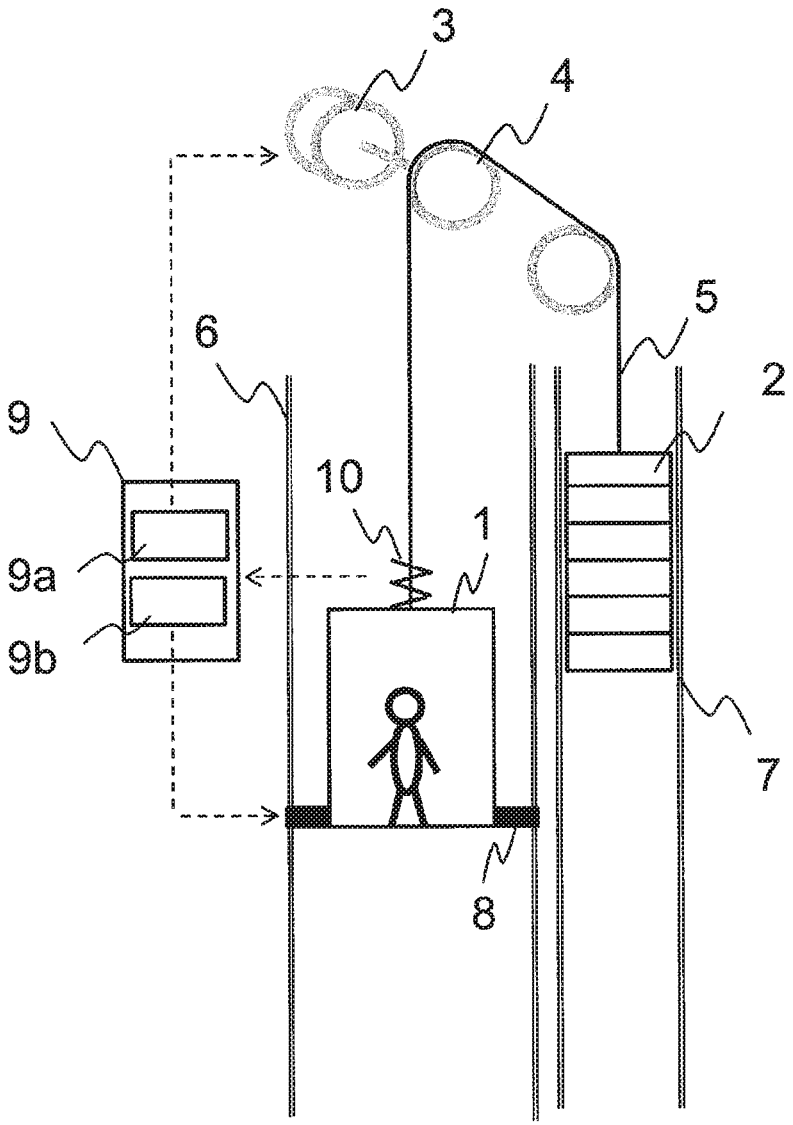
FIG. 1 is a block diagram for illustrating a schematic configuration of an elevator device according to a first embodiment of the present invention.

FIG. 1 is an overall configuration diagram of an elevator device according to a first embodiment of the present invention. The elevator device described in this embodiment is of a traction type. A car 1 and a counterweight 2 are respectively suspended from two ends of a main rope 5 to be supported thereby. The main rope 5 is wound around a sheave 4 to be driven. Through rotation of the sheave 4, which is caused by a hoisting machine 3, a friction force acting between the sheave 4 and the main rope 5 is generated. With the friction force, the main rope 5 is fed to operate the elevator device. The car 1 is vertically raised and lowered while being guided by car guide rails 6, whereas the counterweight 2 is vertically raised and lowered while being guided by counterweight rails 7.

The car 1 includes a car brake device 8 configured to apply a load to the car rails 6 to brake the car 1. The car brake device 8 holds the car rails 6 to prevent stretching and shrinking of the main rope 5 so that the car 1 is not vertically positionally shifted when a user boards or exits the car 1, or is operated in case of emergency such as occurrence of a failure of a device to decelerate and stop the car 1. Besides, the car brake device 8 can be actuated while the car 1 is running. A period in which the car 1 runs includes a period in which the car 1 accelerates, a period in which the car 1 runs at a constant velocity, and a period in which the car 1 decelerates.

Further, the elevator device includes an elevator controller 9 configured to control an operation of the elevator device itself. The elevator controller 9 includes at least a hoisting-machine controller 9*a* and a car brake controller 9*b*. The hoisting-machine controller 9*a* is configured to control drive of the hoisting machine 3. The car brake controller 9*b* is configured to control the car brake device. In addition, the elevator device described above includes a tension detection device 10. The tension detection device 10 is configured to detect a tension of the main rope 5. More specifically, as the tension detection device 10, there are exemplified a break detection device configured to detect break of the main rope 5 based on the load and a weighing device configured to detect a weight in the car based on a change in load.

With the configuration described above, the car brake controller 9*b* is configured to control the car brake device 8 to generate the braking force based on an output signal from the tension detection device 10 under a state in which the hoisting-machine controller 9*a* controls the drive of the hoisting machine 3. Thus, when the tension detection device 10 detects vibration associated with car shaking to control the car brake device 8 to generate the braking force while the car 1 is running, the shaking of the car 1, which is caused by the stretching and shrinking of the main rope 5, can be suppressed. Specifically, the tension detecting device 10 functions as a vibration detection device configured to detect the vibration associated with the car shaking.

Figure 2:
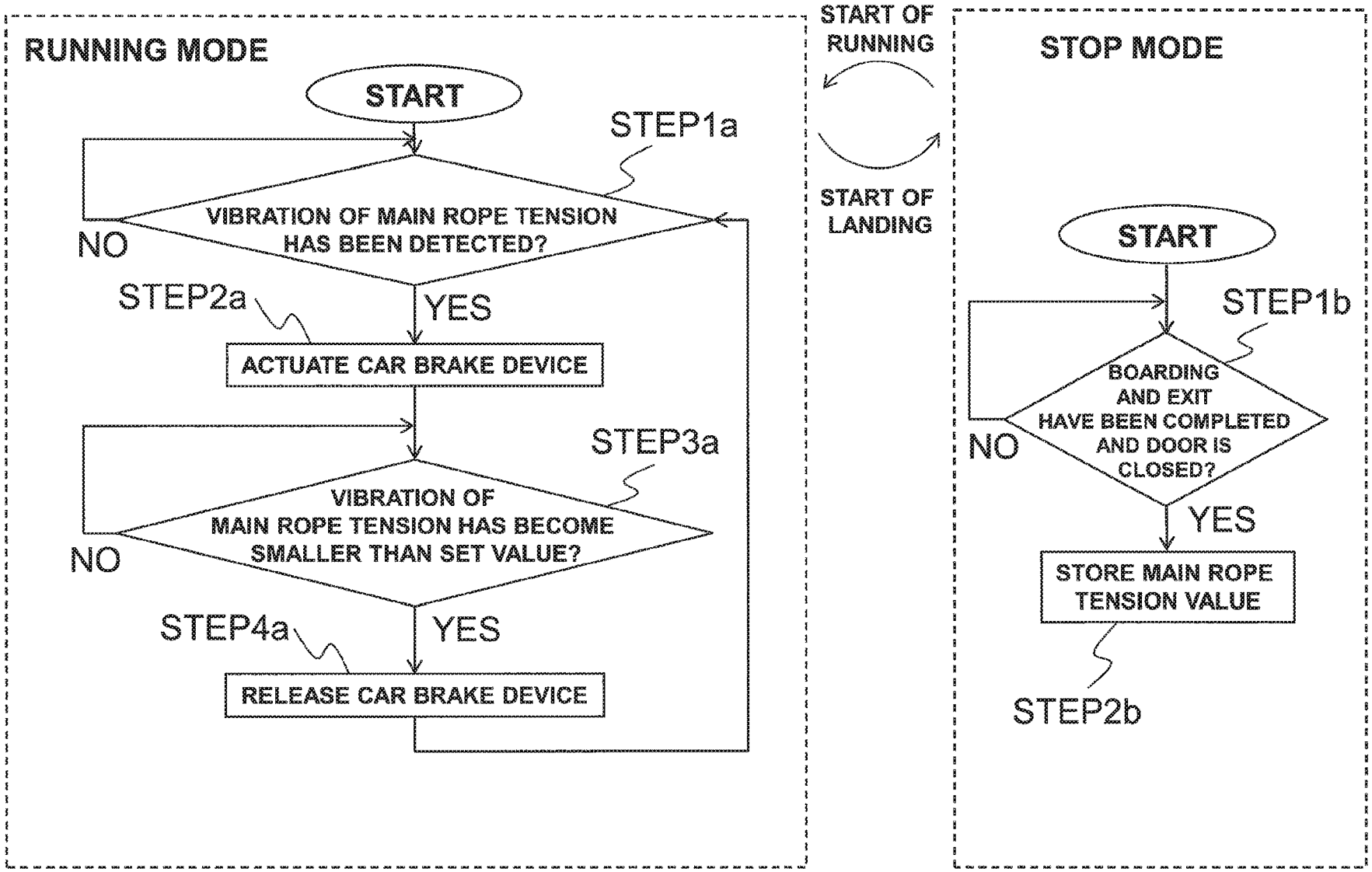
FIG. 2 is a flowchart for illustrating processing to be performed by the elevator device according to the first embodiment of the present invention.

FIG. 2 is an illustration of a processing flow when the elevator device according to the first embodiment of the present invention suppresses the shaking of the car 1 due to the stretching and shrinking of the main rope 5 through the generation of the braking force by the car brake device 8 while the car 1 is running. States of the elevator device when the elevator is in service are roughly classified into a running state (in a case of a running mode in FIG. 2) and a stop state (in a case of a stop mode in FIG. 2). A transition from the stop state to the running state is effected in response to start of running, and a transition from the running state to the stop state is effected in response to start of landing.

In the stop mode in FIG. 2, it is determined that boarding or exit of the user has been completed and door closure has been completed (a door is closed) (STEP 1*b*). After the door closure is confirmed, a value of a tension of the main rope 5 (hereinafter referred to as "main rope tension") at the time of door closure is stored (STEP 2*b*).

Meanwhile, in the running mode in FIG. 2, after the running is started, it is determined from a change in vibration of the main rope tension based on the signal from the tension detection device 10 whether or not the vibration of the car 1 has occurred (STEP 1*a*). Subsequently, when the vibration of the car 1 is detected based on the output signal from the tension detection device 10, the car brake device 8 is actuated to suppress the vibration of the car 1 under the running state in which the hoisting-machine controller 9*a* controls the drive of the hoisting machine 3 (STEP 2*a*). Specifically, the car brake device 8 is actuated to change a resonant frequency of the main rope 5 in accordance with a magnitude of the main rope tension. In this manner, a frequency of the vibration that has already been excited is shifted from the resonant frequency, thereby being capable of suppressing and eliminating resonance.

After that, it is determined whether or not the vibration of the main rope tension has become smaller than a set value (STEP 3*a*). When the vibration of the main rope tension has become smaller than the set value, the car brake device 8 is released. Then, the processing returns to STEP 1*a* where the generation of the vibration of the main rope tension is checked (STEP 1*a*). A magnitude of the braking force of the car brake device 8 may be constant or may be periodically changed as described later. In general, during the period in which the car 1 is accelerated or the period in which the car 1 is controlled to run at a constant velocity, the car brake device 8 is not actuated to perform braking. However, when the vibration of the car 1 is detected especially in any one of the periods described above, the braking force of the car brake device 8 is generated to thereby obtain a vibration suppression effect, which has not been obtained in the related art. The vibration suppression effect is obtained because the tension of the main rope 5 can be directly controlled at both ends of the main rope 5.

Figure 3A:
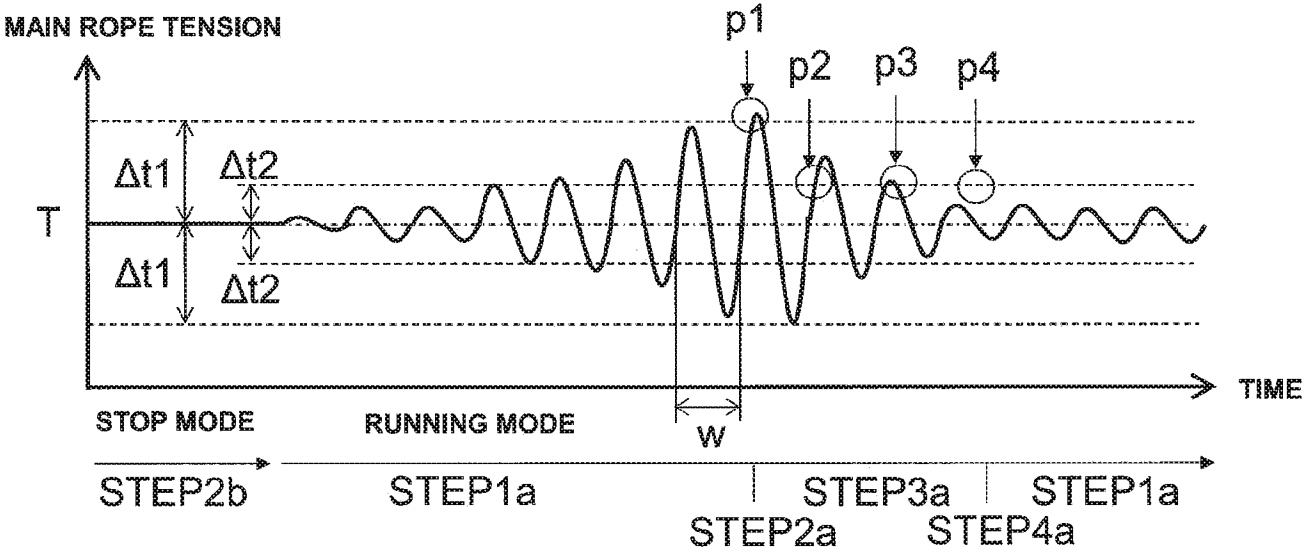
FIG. 3A is a graph for showing a temporal change in main rope tension of the elevator device according to the first embodiment of the present invention.
Figure 3B:
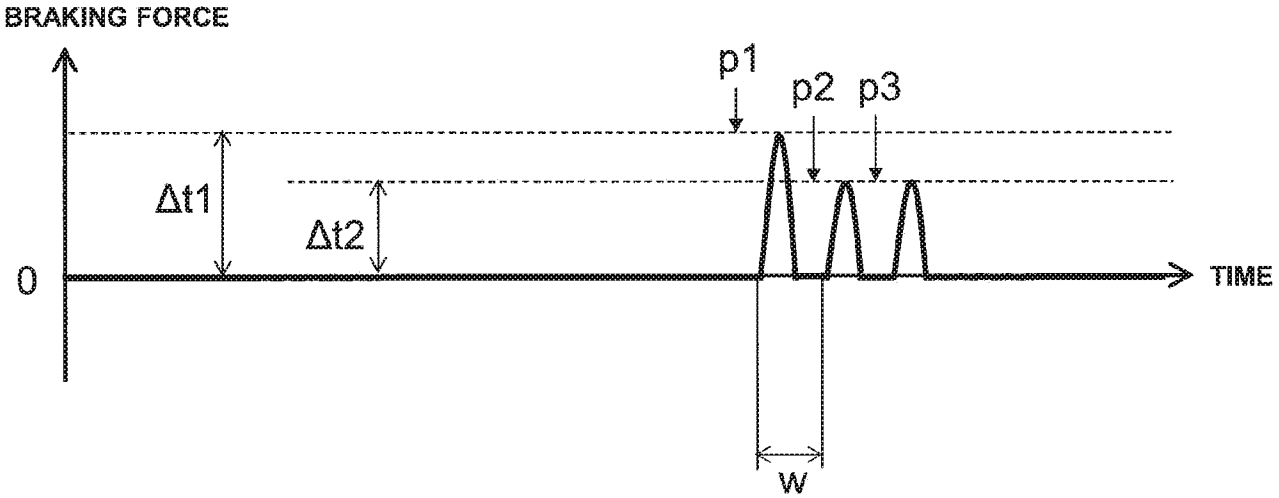
FIG. 3B is a graph for showing a temporal change in braking force of the elevator device according to the first embodiment of the present invention.

FIG. 3A and FIG. 3B are graphs for showing a temporal change in main rope tension and a temporal change in braking force, respectively, when shaking of the car 1, which may be caused by stretching and shrinking of the main rope 5, is efficiently suppressed through the generation of the braking force by the car brake device 8 while the car 1 is running.

The braking force in FIG. 3B acts in a direction of raising the car 1 under a state in which the car 1 is lowered, and acts in a direction of lowering the car 1 under a state in which the car 1 is raised. For each of the braking force of FIG. 3B and the main rope tension of FIG. 3A, a force acting upward with respect to the car is exemplified as a force in a positive direction. In a lower part of the graph of FIG. 3A for showing the temporal change in main rope tension, corresponding modes and processing STEPs are shown. Specific contents of determination in each of STEPs are described below.

In the stop mode in FIG. 2, after the door is closed by the user, the main rope tension of FIG. 3A is basically maintained at a constant value. The main rope tension (hereinafter referred to as "T") in the state of being maintained at the constant value is stored as a main rope tension value (STEP 2*b*). Then, after the running is started, the stop mode is switched to the running mode in FIG. 2. In this example, it is supposed that the vibration of the main rope tension increases after the switching to the running mode. The vibration of the main rope tension is caused by, for example, vertical shaking of the car 1, which is unnecessarily caused by the user in the car 1, disturbance caused by strain of the rails 6, or resonance of a system.

After the stop mode is switched to the running mode in FIG. 2, the vibration of the main rope tension is first detected, specifically, the generation of the vibration of the main rope tension equal to or larger than a set value is first determined (STEP 1*a*). More specifically, the generation of the vibration of the main rope tension can be determined from the stored main rope tension value T (STEP 2*b*) based on whether or not a tension having a magnitude equal to or larger than Δt1, which is predetermined as an unallowable tension amplitude, has been generated.

When it is determined that the vibration of the main rope tension has occurred, the car brake device 8 is actuated (STEP 2*a*). Then, it is determined whether or not the vibration of the main rope tension has become smaller than a set value, specifically, whether the vibration of the main rope tension, which is equal to or larger than the set value, has not occurred (STEP 3*a*).

More specifically, it is determined based on the stored main rope tension value T (STEP 2*b*) whether the tension having a magnitude equal to or larger than Δt2, which is predetermined as an allowable range of tension amplitude, has been absent for a given period of time. When a result of determination is YES, it is determined that the vibration of the main rope tension has converged, and the car brake device 8 is released (STEP 4*a*). In this case, the given period of time can be suitably determined. However, it is considered that the given period of time is determined based on, for example, one period w of the vibration of the main rope tension as a reference. The one period w can be set to, as illustrated in FIG. 3A, a time interval between times at each of which the detected main rope tension intersects with the tension value T.

Meanwhile, in order to efficiently suppress the vibration of the main rope tension, it is preferred to generate the braking force of the car brake device 8 in a direction of suppressing the stretching and shrinking of the vibration of the main rope. Thus, it is preferred that the braking force be exerted in a direction in which the car is lowered at timing of decreasing the tension or be exerted in a direction in which the car 1 is raised at timing of increasing the tension. When the car brake device 8 is operated at the above-mentioned timing, with the same period as the vibration of the main rope tension, the braking force is applied in an upward direction for the car 1 at timing at which the main rope tension becomes weak. Specifically, as illustrated in FIG. 3A, the braking force is applied at such timing that the same period as and a phase opposite to the vibration of the main rope tension are obtained to thereby cancel a tension fluctuation period of the main rope 5. In this manner, the vibration can be suppressed.

Further, as illustrated in FIG. 3B, the magnitude of the braking force can be suitably determined. However, with the setting of the magnitude of the braking force to the same magnitude as the magnitude of the detected main rope tension, the vibration of the main rope tension can be efficiently suppressed. When the car brake device 8 does not have sufficient control responsiveness to generate the same braking force as the detected main rope tension even though the main rope tension is detected, the vibration can be efficiently suppressed even by a method of detecting a maximum amplitude of the rope tension at a time one-half period earlier to generate the braking force of the same magnitude.

Further, as illustrated in FIG. 3B, an amplitude level of the braking force is changed in accordance with magnitudes of the vibration of the main rope tension, which are detected at times p1, p2, and p3. In this manner, the risk of generation of a braking force larger than needed by the car brake device 8 to cause unintentional shaking can be reduced.

In the elevator device in this embodiment, the vibration of the main rope tension of the main rope 5 is detected by the tension detection device 10 arranged on top of an outer side of the car 1. However, a tension detection device arranged at another position may be used as long as the main rope tension can be checked.

As described above, in the elevator device according to the first embodiment of the present invention, the shaking of the car that is currently running is controlled by the car brake controller. With the control described above, the effect of reducing the shaking of the car due to the stretching and shrinking of the main rope to improve the ride comfort is obtained. In particular, the shaking of the car is sometimes increased at an acceleration at a switching point between a section in which the car is accelerated or decelerated and a section in which the car is operated at a constantly maintained velocity. The control may be performed so as to directly detect the shaking with high sensitivity to suppress the shaking.

Hitherto, when the drive control is performed so as to achieve the acceleration or the constant velocity, the braking force of the brake is not generated on the car side. Thus, it is difficult to suppress the shaking due to the stretching and shrinking of the main rope on the hoisting machine side. According to this embodiment, the tension can be directly controlled at both ends of the main rope. Accordingly, the shaking can easily be suppressed.

Second Embodiment

Figure 4:
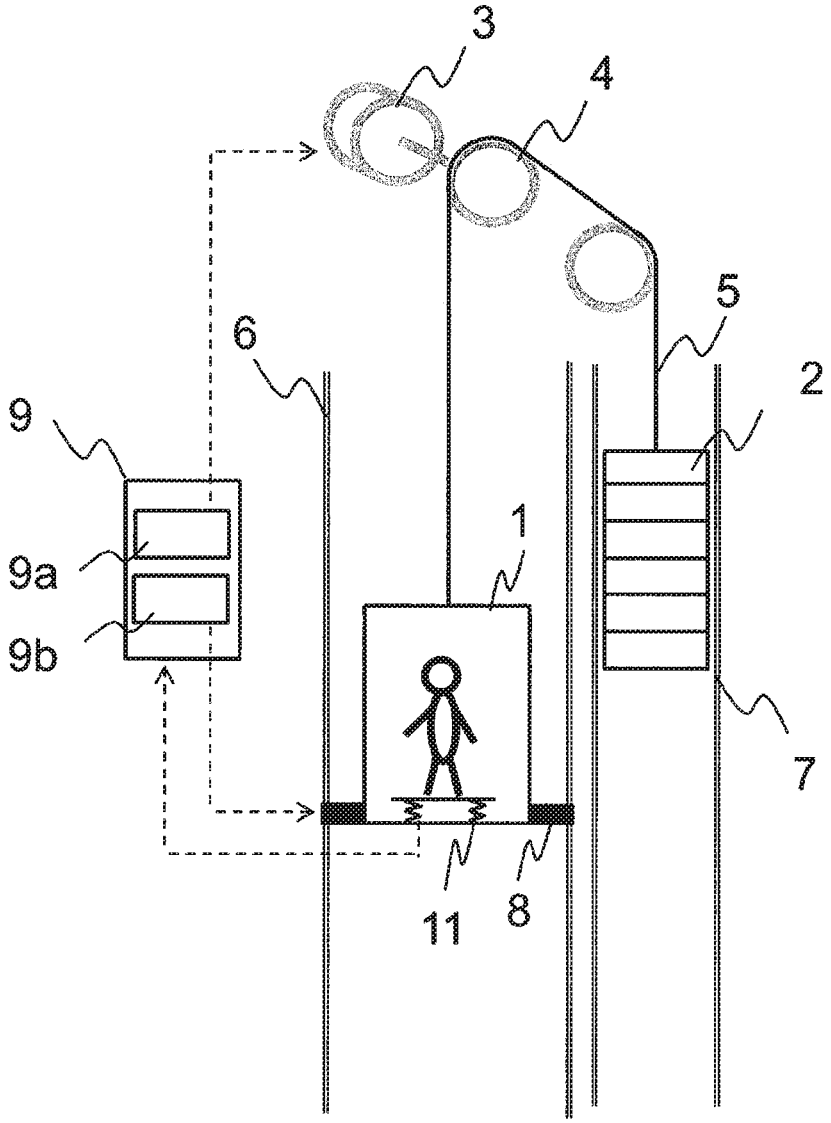
FIG. 4 is a block diagram for illustrating a schematic configuration of an elevator device according to a second embodiment of the present invention.

FIG. 4 is an overall configuration diagram of an elevator device according to a second embodiment of the present invention. The elevator device includes a load detection device 11 configured to detect a live weight load in the car 1 at an inner floor position of the car 1 in place of the tension detection device in the configuration of FIG. 1.

In this embodiment, the vibration of the main rope tension cannot be directly detected. However, under a state in which a fluctuation in tension of the main rope 5 occurs to shake the car 1, a load value output from the load detection device 11 provided in the car 1 also oscillates. The car brake device 8 is controlled to generate a braking force corresponding to the load value. With the thus generated braking force, the shaking can be suppressed.

In particular, for a fluctuation in main rope tension, which is caused by the user who is present in the car 1 and shakes the car 1, an external force applied from inside of the car 1 can be directly detected at a position of the car 1. Thus, the vibration of the car 1 can be directly suppressed in a direction in which the external force is cancelled by the car brake device 8. Accordingly, the shaking of the car 1 can be efficiently reduced with high accuracy.

Also in this embodiment, the load detection device 11 functions as the vibration detection device configured to detect the vibration of the car 1. For the control of the car brake device 8, which is performed so as to suppress the detected vibration, the same method as that of the first embodiment may be used.

As described above, in the elevator device according to the second embodiment of the present invention, the car brake controller controls the car brake device so as to efficiently cancel the shaking of the car that is currently running, especially, the external force applied from inside of the car to generate the braking force. With the braking force, the effect of reducing the shaking of the car due to the stretching and shrinking of the main rope to improve the ride comfort is obtained.

Third Embodiment

Figure 5:
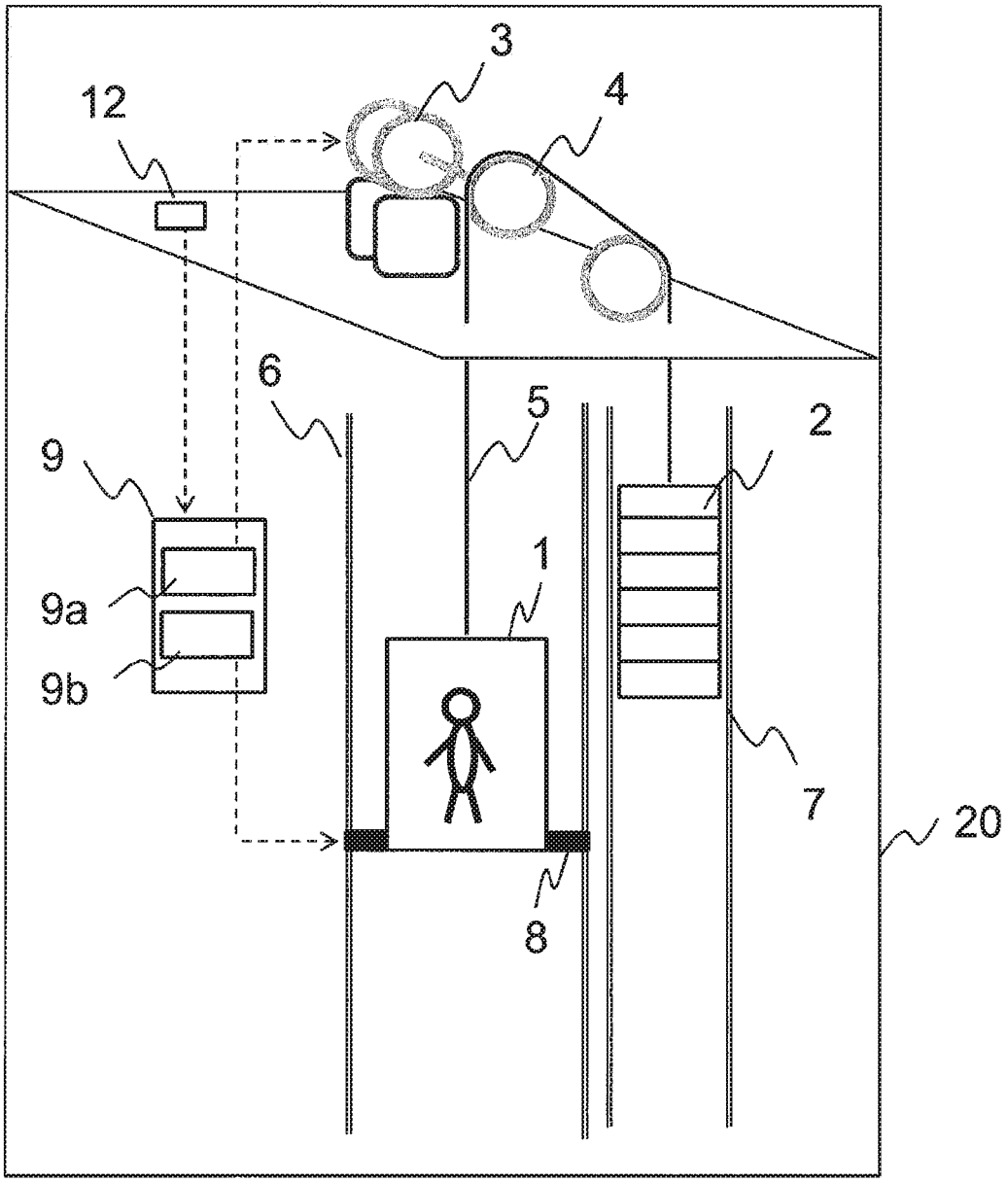
FIG. 5 is a block diagram for illustrating a schematic configuration of an elevator device according to a third embodiment of the present invention.

FIG. 5 is an overall configuration diagram of an elevator device according to a third embodiment of the present invention. When this embodiment is compared to FIG. 1 for illustrating the first embodiment, a shaking detection device 12 configured to detect shaking of a construction 20 for accommodating the elevator device therein is provided in place of the tension detection device 10. A general elevator device includes an earthquake sensor corresponding to the shaking detection device. With the shaking detection device, the elevator controller can detect a magnitude of the shaking of the construction 20. The shaking detection device 12 is one kind of the vibration detection device configured to detect the vibration of the car 1.

In a case in which the elevator controller 9 detects the shaking of the construction, which is equal to or larger than a set value, there is a risk in that, when the construction shakes side-to-side due to an earthquake or a strong wind, the main rope 5 may swing due to the resonance to collide against and damage a device in a hoistway. Thus, it is common to temporarily stop the service and restart the service after an inspection.

Meanwhile, the elevator device according to the present invention includes the car brake controller 9*b*. Thus, under the running state in which the hoisting-machine controller 9*a* controls the drive of the hoisting machine 3, the braking force of the car brake device 8 can be generated. In particular, the drive of the hoisting machine 3 can be controlled in accordance with the shaking of the construction, which is caused by the earthquake or the strong wind. Accordingly, through the control of the drive of the hoisting machine 3 so as to suppress the vibration of the main rope 5 due to the earthquake or the strong wind, the oscillation of the main rope 5 is suppressed. In this manner, the swing of the main rope 5, which may be caused by the resonance, can be prevented so as to avoid the collision against the device in the hoistway.

Figure 6:
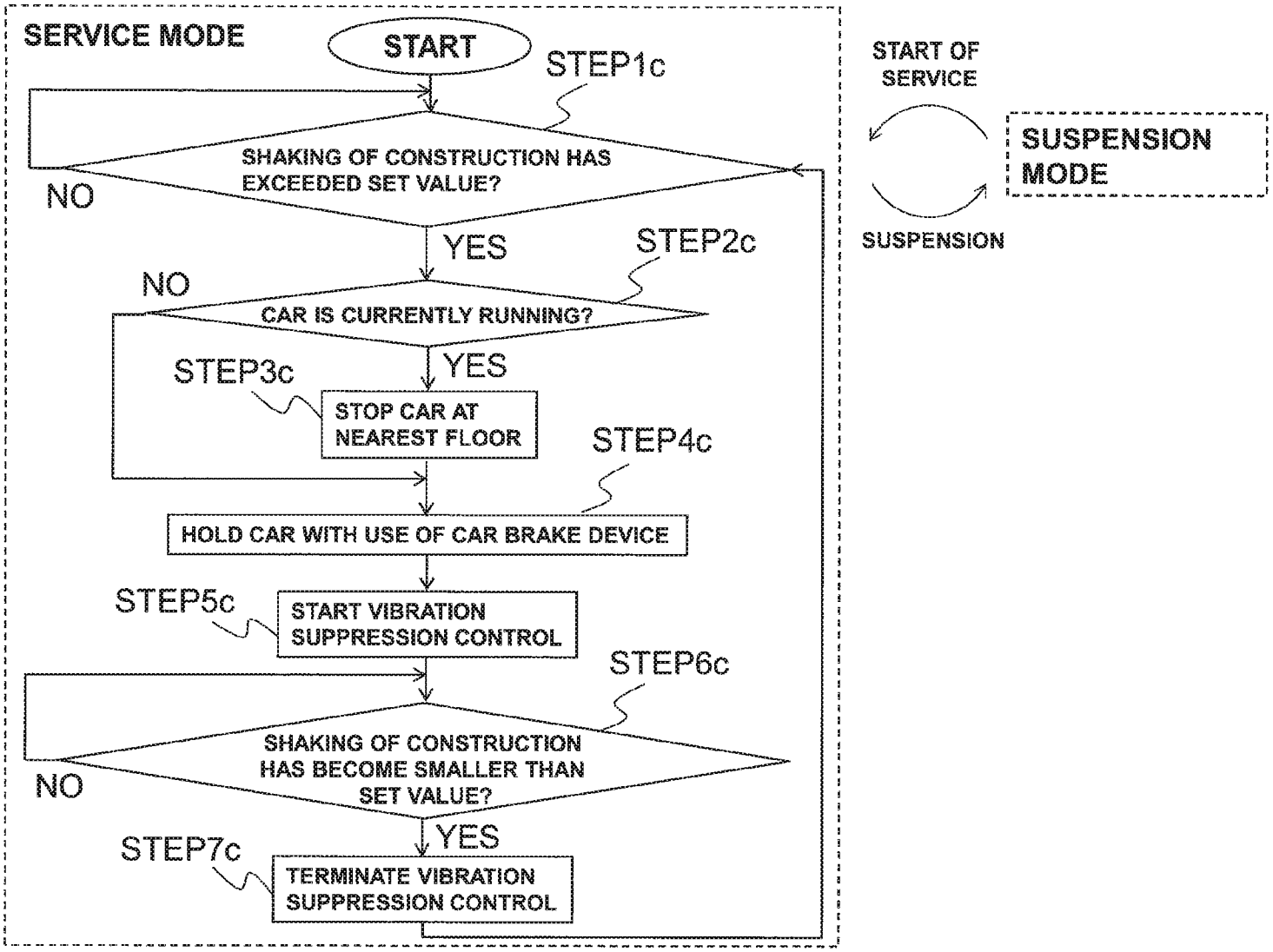
FIG. 6 is a flowchart for illustrating a processing operation to be performed by the elevator device according to the third embodiment of the present invention.

FIG. 6 is an illustration of a processing flow to be performed when the elevator device according to the third embodiment of the present invention controls the drive of the hoisting machine 3 in accordance with the shaking of the construction 20 to suppress the oscillation of the main rope 5. States in the processing flow can be roughly classified into a state in which an event is in service (in a service mode in FIG. 6) and a suspension state (in a suspension mode in FIG. 6). A transition from the suspension state to the service state is effected in response to start of the service, and a transition from the service state to the suspension state is effected in response to suspension of the service.

In the suspension mode in FIG. 6, the elevator device is not particularly driven, and hence no operation is performed. After the service is started, the suspension mode is switched to the service mode in FIG. 6. Then, the elevator controller 9 determines based on an output signal from the shaking detection device 12 whether or not the shaking of the construction 20 has exceeded a set value (STEP 1*c*). When it is determined that the shaking of the construction 20 has become equal to or larger than the set value (YES), it is then determined whether or not the car 1 is currently running (STEP 2*c*). As a result, when the car 1 is currently running, the car 1 is stopped at the nearest floor (STEP 3*c*). After that, under a state in which the car 1 is stopped, the car brake device 8 is actuated to hold the car 1 at a stop position (STEP 4*c*). Then, under a state in which the car 1 is held, the control of the drive of the hoisting machine 3 is started to suppress the oscillation of the main rope 5 (STEP 5*c*). After that, after it is confirmed that the shaking of the construction 20 has become smaller than the set value, the drive control is terminated (STEP 6*c*, STEP 7*c*).

Next, a specific control method of suppressing the shaking of the car 1, specifically, the oscillation of the main rope 5 in this embodiment is described. Lateral oscillation of the main rope 5 is increased because a natural frequency of the shaking of the construction 20 and a natural frequency of the lateral oscillation of the main rope 5 match each other. Through control for preventing the matching between the natural frequencies, the vibration of the car 1 can be suppressed. The event is comprehended as a single string vibration, and the natural frequency of the lateral oscillation of the main rope 5 is calculated by the following expression.

$$v = \frac{1}{2 \times 1}\sqrt{\frac{T}{\rho}} \qquad \text{(Expression 1)}$$

In Expression 1, v represents the natural frequency of the lateral oscillation of the main rope 5, l represents a length of the vibrating main rope 5, ρ represents a linear density of the main rope 5, and T represents the tension applied to the main rope 5.

From Expression 1, it is understood that the natural frequency can be freely changed through the control of the tension. Accordingly, as illustrated in the processing flow for the service mode in FIG. 6, when the drive of the hoisting machine 3 is controlled under a state in which the car 1 is held in a stopped state by the car brake device 8, the tension of the main rope 5 from the car 1 to the sheave 4 can be controlled. The main rope tension T is changed so that the natural frequency of the detected shaking of the construction 20 and the natural frequency of the main rope 5 are separate from each other. In this manner, the natural vibration of the main rope 5 is prevented from being excited by the shaking of the construction 20.

Further, in this embodiment, the detection of the shaking of the construction 20 and the detection of the vibration of the car 1 are associated with each other. However, the same effects are obtained even in the following manner. In the first embodiment of FIG. 1, the tension of the main rope 5 is detected by the tension detection device 10. After the frequency of the shaking of the construction 20 is detected from a change in main rope tension, the tension of the main rope 5 is changed through the control of the drive of the hoisting machine 3 so as to separate the natural frequency of the main rope 5 from the detected frequency of the shaking of the construction 20.

In this case, the tension of the main rope 5 is required to be controlled with attention focused on the fact that the frequency of the lateral oscillation of the main rope 5 is detected as half of a frequency of vertical oscillation of the main rope 5. Specifically, after the main rope tension is regulated assuming that the construction 20 shakes side-to-side in a period equal to half of the frequency of the main rope 5, which is to be detected, the natural frequency of the lateral oscillation is required to be controlled.

As described above, in the elevator device according to the third embodiment of the present invention, through the control of the natural frequency of the main rope, the resonance of the main rope is suppressed even when the construction shakes due to, for example, the earthquake or the strong wind. As a result, the effect of preventing the collision of the main rope against the device in the hoistway so as not to damage the device in the hoistway is obtained.

REFERENCE SIGNS LIST

1 car, 2 counterweight, 3 hoisting machine, 4 sheave, 5 main rope, 6 car rail, 7 counterweight rail, 8 car brake device, 9 elevator controller, 9*a* hoisting-machine controller, 9*b* car brake controller, 10 tension detection device, 11 load detection device, 12 shaking detection device, 20 construction

The invention claimed is:

1. An elevator device, comprising:

a car;

a counterweight;

a main rope configured to support the car and the counterweight;

a hoisting machine to be driven with the main rope wound therearound;

car rails configured to guide the car;

a car brake device configured to apply a load to the car rails to brake the car;

a hoisting-machine controller configured to control the hoisting machine;

a car brake controller configured to control the car brake device; and a vibration detection device configured to detect vibration of the car or vibration of a construction for accommodating the elevator device therein, wherein, when the car brake controller detects the vibration of a tension of the main rope, the car brake controller controls the car brake device to generate the braking force, wherein, under a state in which the hoisting-machine controller controls drive of the hoisting machine and the car brake controller controls the car brake device to generate a braking force, the control of the drive of the hoisting machine is continued, wherein, the car brake controller changes the braking force to be generated by the car brake device in accordance with a signal indicative of the vibration detected by the vibration detection device, wherein, the car brake controller controls the car brake device to generate the braking force exerted in a direction in which the car is lowered at a timing of decreasing the tension of the main rope, or the braking force exerted in a direction in which the car rises at a timing of increasing the tension of the main rope.

2. The elevator device according to claim 1, wherein the vibration detection device comprises a load detection device configured to detect a load acting between an inner floor of the car and the car brake device as the vibration of the car.

3. The elevator device according to claim 1, wherein the vibration detection device comprises a shaking detection device configured to detect side-to-side shaking of the construction.

4. The elevator device according to claim 3, wherein the vibration detection device is configured to detect the side-to-side shaking of the construction based on a fluctuation in tension of the main rope.

5. The elevator device according to claim 3, wherein, when a magnitude of the side-to-side shaking of the construction is equal to or larger than a set value, the car brake controller controls the car brake device to generate the braking force.

6. The elevator device according to claim 1, wherein a state in which the hoisting-machine controller controls the drive of the hoisting machine comprises an accelerating drive control state and a constant-velocity drive control state.

7. The elevator device according to claim 1, wherein, when the vibration of the car is detected based on the output signal from the vibration detection device, the braking force of the car brake device is generated until the vibration becomes smaller than a set value.

* * * * *